US010153578B2

(12) United States Patent
Sato et al.

(10) Patent No.: US 10,153,578 B2
(45) Date of Patent: Dec. 11, 2018

(54) CONNECTOR STRUCTURE

(71) Applicant: Yazaki Corporation, Minato-ku, Tokyo (JP)

(72) Inventors: Akira Sato, Makinohara (JP); Ryosuke Kamiya, Makinohara (JP); Kenji Takahashi, Makinohara (JP); Teruo Kato, Anjo (JP); Yusuke Hinoda, Anjo (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/000,380

(22) Filed: Jun. 5, 2018

(65) Prior Publication Data

US 2018/0287289 A1 Oct. 4, 2018

Related U.S. Application Data

(63) Continuation of application No. PCT/JP2016/086447, filed on Dec. 7, 2016.

(30) Foreign Application Priority Data

Dec. 11, 2015 (JP) ..... 2015-241791

(51) Int. Cl.
*H01R 13/506* (2006.01)
*H01R 13/56* (2006.01)
*H01R 13/627* (2006.01)

(52) U.S. Cl.
CPC ..... *H01R 13/506* (2013.01); *H01R 13/567* (2013.01); *H01R 13/6272* (2013.01)

(58) Field of Classification Search
CPC ... H01R 13/506; H01R 13/5045; H01R 13/22
(Continued)

(56) References Cited

U.S. PATENT DOCUMENTS 5,236,375 A * 8/1993 Kachlic ..... H01R 13/6275 439/607.13
6,095,852 A * 8/2000 Gregory, II ..... H01R 13/506 439/466
(Continued)

FOREIGN PATENT DOCUMENTS

JP 2009-37769 A 2/2009
JP 2012-54206 A 3/2012
(Continued)

OTHER PUBLICATIONS

English translation of Written Opinion dated Feb. 14, 2017, issued by the International Searching Authority in International application No. PCT/JP2016/086447 (PCT/ISA/237).
(Continued)

*Primary Examiner* — Tulsidas C Patel
*Assistant Examiner* — Marcus Harcum
(74) *Attorney, Agent, or Firm* — Sughrue Mion, PLLC

(57) ABSTRACT

A connector structure includes a first connector housing, a second connector housing accommodating the first connector housing, and a cover which restricts a leading-out direction of a wire led out from the first connector housing. The first connector housing, the second connector housing, and the cover are integrally assembled. The cover includes a cover flange, a cover hood formed on a side in the cover flange, a cover arm protruding from a side opposite to the cover hood in the cover flange, and a cover projection protruding from the side opposite to the cover hood in the cover flange and facing part of the cover arm.

4 Claims, 10 Drawing Sheets

(58) Field of Classification Search
USPC ..... 439/701, 521, 901, 694
See application file for complete search history.

(56) References Cited

U.S. PATENT DOCUMENTS 6,213,792 B1 * 4/2001 Tsuji ..... H01R 13/62911 439/152
6,283,799 B1 * 9/2001 Fukase ..... H01R 13/4365 439/752
7,172,468 B2 * 2/2007 Nishide ..... H01R 13/514 439/368
8,057,245 B2 * 11/2011 Sakamaki ..... H01R 13/62933 439/157
9,325,112 B2 * 4/2016 Tabata ..... H01R 13/62905
9,899,770 B2 * 2/2018 Yoshida ..... H01R 13/6275
2013/0102168 A1 * 4/2013 Kobayashi ..... H01R 13/5213 439/141
2014/0127931 A1 * 5/2014 Urashima ..... H01R 13/506 439/352
2014/0357116 A1 * 12/2014 Suzuki ..... H01R 13/447 439/527
2015/0180163 A1 * 6/2015 Saitoh ..... H01R 13/506 439/701

FOREIGN PATENT DOCUMENTS

JP 2013-161530 A 8/2013
WO 2013/115414 A1 8/2013

OTHER PUBLICATIONS

Search Report dated Feb. 14, 2017, issued by the International Searching Authority in International application No. PCT/JP2016/086447 (PCT/ISA/210).
Written Opinion dated Feb. 14, 2017, issued by the International Searching Authority in International application No. PCT/JP2016/086447 (PCT/ISA/237).

* cited by examiner

CONNECTOR STRUCTURE

CROSS REFERENCE TO RELATED APPLICATIONS

This application is a continuation of PCT application No. PCT/JP16/086447, which was filed on Dec. 7, 2016 based on Japanese Patent Application (No. 2015-241791) filed on Dec. 11, 2015, the contents of which are incorporated herein by reference.

BACKGROUND OF THE INVENTION

Field of the Invention

The present invention relates to a connector structure, and particularly to a connector structure in which a cover, a female connector housing, and a male connector housing are integrally assembled.

Description of Related Art

In the related art, as a connector provided with an electric wire cover which is assembled to a connector housing and bends an electric wire (is the same as a wire) led out of the connector housing to the rear side so as to be led in a predetermined leading-out direction, there is disclosed an invention in which an engaging claw (projecting portion) and a reception groove (recess portion) extending forward are formed in an outer side surface of the connector housing, and a deflection portion which is provided with an engaging hole engageable with the engaging claw and a rib which is insertable to the reception groove are formed on both side surfaces of the electric wire cover (see, for example, the patent document 1: JP-A-2012-54206).

[Patent Document 1] JP-A-2012-54206

According to a related art, a slope is formed at an opening edge of a reception groove, a slope contact surface is formed at a tip end of the rib, and a slope and a slope contact surface come into surface contact. Therefore, an electric wire cover can be assembled to a connector housing without degrading workability, and it is possible to suppress the connector housing of the electric wire cover from being rattled.

However, a deflection portion formed with a engaging hole is elastically deformed (expanded) once outward by an engaging claw when a rib is inserted from a rear side to the reception groove extending forward, and then the deflection portion is elastically reaccommodated to cause the engaging claw to be intruded into the engaging hole. At this time, a pressing force causing the electric wire to be bent and a pressing force keeping the bending serve as "a force to detach the electric wire cover" in an insertion direction (a front and rear direction) of the electric wire cover, and are applied to the engaging claw.

Therefore, there is a need to increase rigidity of the deflection portion in order to secure the assembly such that the electric wire cover is not detached from the connector housing. Then, at the time of assembling, there is a need to strongly press the electric wire cover in the insertion direction in order that the deflection portion is pressed against the engaging claw to be elastically deformed (expanded) outward once. Therefore, there is rather a problem that workability is degraded.

Since there is a gap between the engaging hole and the engaging claw in the front and rear direction (is the same as the insertion direction and the detaching direction), the electric wire cover rattles in the front and rear direction, which is problematic.

Since the engaging claw protrudes to the outer side surface of the connector housing, and the deflection portions formed on both side surfaces of the electric wire cover face the outer side surface of the connector housing, a width (a distance between the outer side surfaces of the deflection portion) of the electric wire cover becomes larger than a width (a distance between the outer side surfaces) of the connector housing. Therefore, such a structure goes against a minimization of the connector, and lowers (restricts a device) a flexibility of a device in which the connector can be installed, which is problematic.

SUMMARY

One or more embodiments provide a connector structure in which a width of an electric wire cover is accommodated within a width of a connector housing, and the electric wire cover is assembled to the connector housing easily and securely.

In an aspect (1), one or more embodiments provide A connector structure including a first connector housing, a second connector housing accommodating the first connector housing, and a cover which restricts a leading-out direction of a wire led out from the first connector housing. The first connector housing, the second connector housing, and the cover are integrally assembled. The cover includes a cover flange, a cover hood formed on a side in the cover flange, a cover arm protruding from a side opposite to the cover hood in the cover flange, and a cover projection protruding from the side opposite to the cover hood in the cover flange and facing part of the cover arm. The first connector housing includes a rib formed on one of two facing outer surfaces along a direction in which the cover is assembled, a rib groove formed by a notching part of the rib, and an engaging lock formed on an outer surface. The second connector housing includes an engaging lock groove in which the engaging lock is engaged, a rib accommodating notched portion accommodating the rib, and a cover arm accommodating notched portion which is continuous to the rib accommodating notched portion and accommodates the cover arm. In a state that the cover is assembled to the first connector housing accommodated in the second connector housing, the rib is accommodated in the rib accommodating notched portion, the engaging lock is engaged with the engaging lock groove, the cover arm is accommodated in the cover arm accommodating notched portion, the rib is positioned between the cover flange and the cover arm, and the cover projection is positioned in the rib groove.

In an aspect (2), the cover arm includes a cover arm parallel portion which is in parallel to an end surface of the cover flange and a cover arm vertical portion which is perpendicular to the end surface of the cover flange, and the cover projection is disposed at a position facing the cover arm parallel portion. The rib accommodated in the rib accommodating notched portion is positioned in a space which is formed by three of part of the end surface of the cover flange, the cover arm parallel portion, and the cover arm vertical portion and has one open surface.

In an aspect (3), the cover arm accommodating notched portion includes a stopper abutting on a surface on a side of the cover arm in an intruding direction.

According to the aspect (1), the cover arm of the cover is intruded to the cover arm accommodating notched portion of the male connector and the cover projection of the cover is intruded to the rib groove of the female connector, in a state where the rib is intruded to the rib accommodating notched portion, the engaging lock is engaged with the engaging lock groove, and the female connector housing is fixed to a male connector housing. Therefore, the cover is undetachable due to the rib and the rib groove of the female connector, further is suppressed from rattling, and is assembled securely.

According to the aspect (2), since the cover arm can be intruded to the cover arm accommodating notched portion of the male connector without causing the cover arm of the cover to be elastically deformed, the assembling is easy, and the workability is good.

According to the aspect (3), the rib of the female connector housing is accommodated in the rib accommodating notched portion of the male connector housing, the cover arm of the cover is accommodated in the cover arm accommodating notched portion of the male connector housing. Therefore, the cover does not protrude to the outer surface of the male connector housing. In other words, the female connector housing and the cover are accommodated within the width of the male connector housing, so that a connector structure can be minimized.

DETAILED DESCRIPTION

First Embodiment

Hereinafter, a mode (hereinafter, referred to as "first embodiment") for carrying out the invention will be described with reference to the drawings. Incidentally, the invention is not limited to the embodiment of the drawings. In order to avoid that the drawings become complex, descriptions of some parts or some symbols are omitted in some cases.

(Connector Structure)

Figure 1:
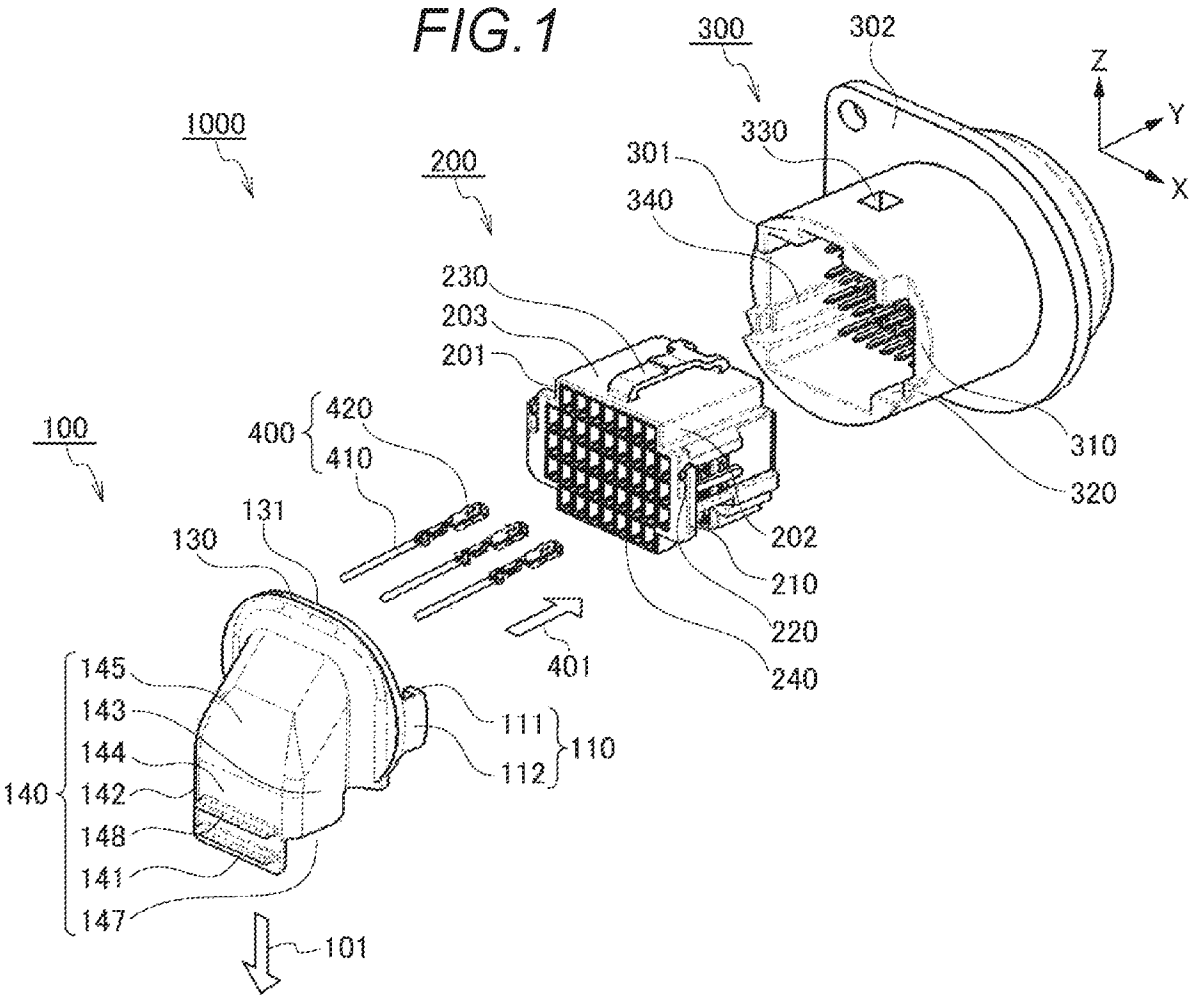
FIG. 1 is a perspective view for describing a connector structure according to a first embodiment of the invention, in which components are exploded.

FIG. 1 is a perspective view for describing a connector structure according to the first embodiment of the invention, in which components are exploded.

In FIG. 1, in a connector structure 1000, a cover 100, a female connector housing 200, and a male connector housing 300 are integrally assembled.

In other words, a crimp terminal 420 of a wire harness 400 is inserted to the female connector housing 200 in a direction (hereinafter, referred to as "wire harness inserting direction") 401 indicated by a thick arrow. The male connector housing 300 accommodates the female connector housing 200. Then, the cover 100 restricts a wire 410 of the wire harness 400 to be led out in a direction (hereinafter, referred to as "wire harness leading-out direction") 101 indicated by a thick arrow. Hereinafter, these components will be described.

Incidentally, for the convenience of explanation below, the wire harness inserting direction 401 is called "Y direction" or "end surface direction", the opposite direction to a wire leading-out direction 101 is called "Z direction" or "rear surface direction", and a direction perpendicular to the Y direction and the Z direction is called "X direction" or "side surface direction". Then, a drawing viewed in the X direction is called a "side view", a drawing viewed in the Y direction is called "top view", a drawing viewed in the Z direction (the opposite direction to the wire leading-out direction 101) is called "front view", and a drawing viewed in a -Z direction (the wire leading-out direction 101) is called "rear view".

(Cover)

Figure 2:
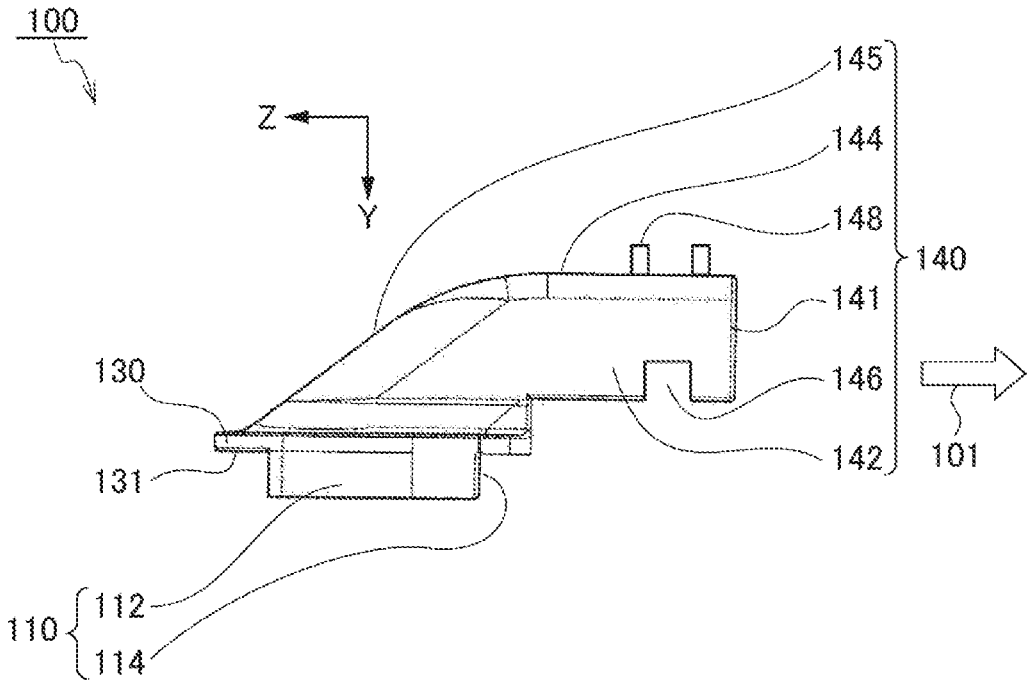
FIG. 2 is a side view illustrating a part (cover) of the components for describing the connector structure according to the first embodiment of the invention.
Figure 3:
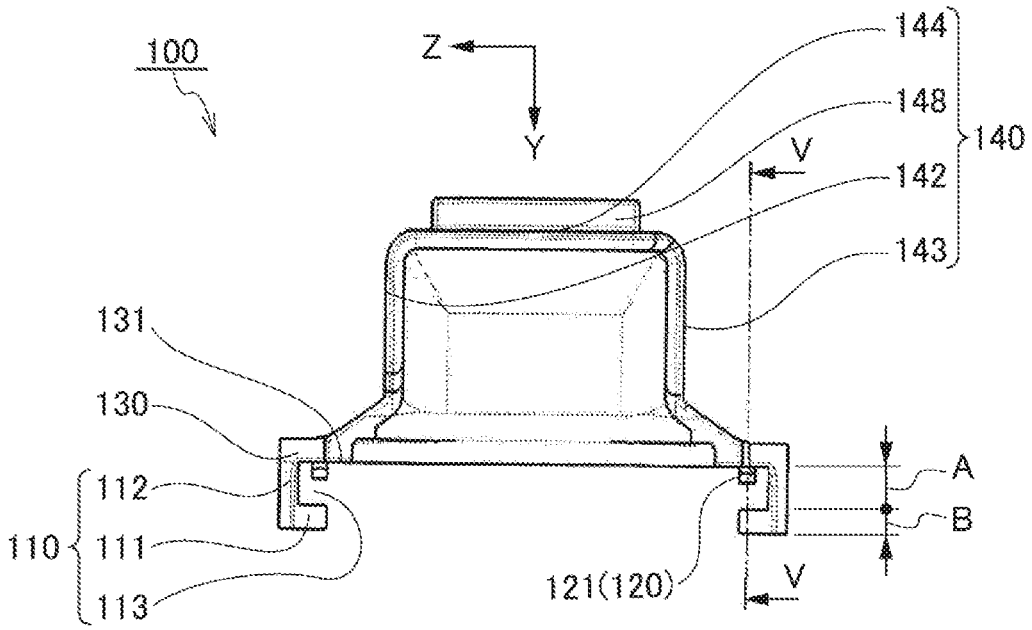
FIG. 3 is a front view illustrating the part (cover) of the components for describing the connector structure according to the first embodiment of the invention.
Figure 4:
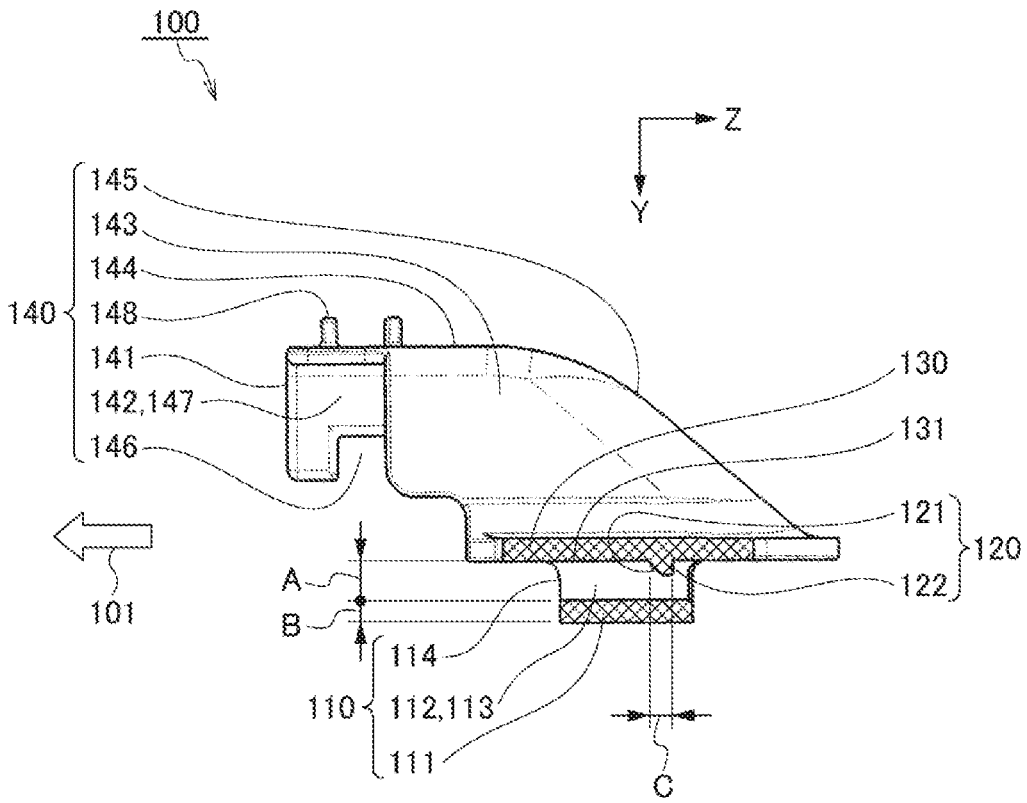
FIG. 4 is a cross-sectional view taken along a line V-V in FIG. 3 for describing the connector structure according to the first embodiment of the invention.

FIGS. 2 to 4 are drawings for describing the connector structure according to the first embodiment of the invention. FIG. 2 is a side view illustrating a part (cover) of the components. FIG. 3 is a front view illustrating the part (cover) of the components. FIG. 4 is a cross-sectional view taken along a line V-V in FIG. 3. Incidentally, for the convenience of explanation, the X direction, the Y direction, and the Z direction are additionally depicted in FIG. 1.

In FIGS. 2 to 4 and also in FIG. 1, the cover 100 includes a cover flange 130 having an approximately horse-shoe shape, a cover hood 140 which is continuous to the cover flange 130 on a side in the cover flange 130, a cover arm 110 which is provided at a position facing the end surface (hereinafter, referred to as "cover flange end surface") 131 of the cover flange 130 and protrudes from the opposite side to the cover hood 140, and a cover projection 120 which protrudes from the opposite side to the cover hood 140 and is at a position facing part of the cover arm. Hereinafter, these components will be described.

(Cover Arm)

The cover arm 110 includes a cover arm parallel portion 111 which is in parallel to the cover flange end surface 131, and a cover arm vertical portion 112 which is perpendicular to the cover flange end surface 131. A cover arm space 113 is formed by three of part of the cover flange end surface 131, the cover arm parallel portion 111, and the cover arm vertical portion 112 to have one open surface.

Incidentally, a surface on a side of the cover arm 110 in the wire leading-out direction 101 (-Z direction side) is referred to as "cover positioning surface 114". A distance (hereinafter, referred to as "cover arm gap") between the cover flange end surface 131 and the cover arm parallel portion 111 is set to "A", and a thickness (a distance in the Y direction) of the cover arm parallel portion 111 is set to "B".

(Cover Projection)

The cover projection 120 protrudes from the cover flange end surface 131 into the cover arm space 113, and faces the cover arm parallel portion 111. A surface (is the same as the surface on a side in the -Z direction; hereinafter, referred to as "cover projection sliding surface") 121 on a side of the cover projection 120 in the wire leading-out direction 101 is inclined such that the protruding amount is increased as it goes to the opposite side (Z direction) in the wire leading-out direction 101, and the end surface (is the same as the surface on a side in the Z direction; hereinafter, referred to as "cover projection intrusion surface") 122 of the cover projection 120 on the opposite side in the wire leading-out direction 101 is approximately perpendicular to the cover flange end surface 131.

In other words, the cover projection 120 has an approximately triangular shape in cross-sectional view. Incidentally, the length of the cover projection 120 in the Z direction (is the same as the distance between a portion rising from the cover flange end surface 131 of the cover projection sliding surface 121 and the cover projection intrusion surface 122) is set to "C".

(Cover Hood)

In the cover hood 140, a surface (a surface in almost parallel to the X-Y plane; hereinafter, referred to as "cover hood end surface") 141 on a side near the wire leading-out direction 101 is opened. There are provided a cover hood left side surface 142 and a cover hood right side surface 143 which face each other and are in almost parallel to the Y-Z plane, a cover hood parallel surface 144 which connects the edges on one side of the cover hood left side surface 142 and the cover hood right side surface 143 and is in parallel to the cover flange end surface 131, and a cover hood slope 145 which is connected to the cover hood left side surface 142, the cover hood right side surface 143, and the cover hood parallel surface 144 and is inclined to approach the cover hood end surface 141 as it goes away from the cover flange end surface 131.

A cover hood notched portion 146 is formed at the edge on the opposite side to the cover hood parallel surface 144 of the cover hood left side surface 142, and a predetermined range near the cover hood end surface 141 of the cover hood right side surface 143 is deficient to form a cover hood deficient portion 147.

Cover hood projecting strips 148 configured by a pair of projecting strips are formed in parallel to each other in the surface on the opposite side to the cover flange end surface 131 of the cover hood parallel surface 144.

In the cover 100 of the invention, the shapes of the cover flange 130 and the cover hood 140 are not limited as long as the cover arm 110 and the cover projection 120 are provided.

For example, the cover hood left side surface 142 and the cover hood right side surface 143 may be connected by a member different from those of the cover hood parallel surface 144 and the cover hood slope 145. The cover hood notched portion 146, the cover hood deficient portion 147, and the cover hood projecting strip 148 are used to easily and securely bind a binding band 500 (this will be separately described in detail), but any one or more of the cover hood notched portion 146, the cover hood deficient portion 147, and the cover hood projecting strip 148 may be not provided.

(Female Connector Housing)

Figure 5:
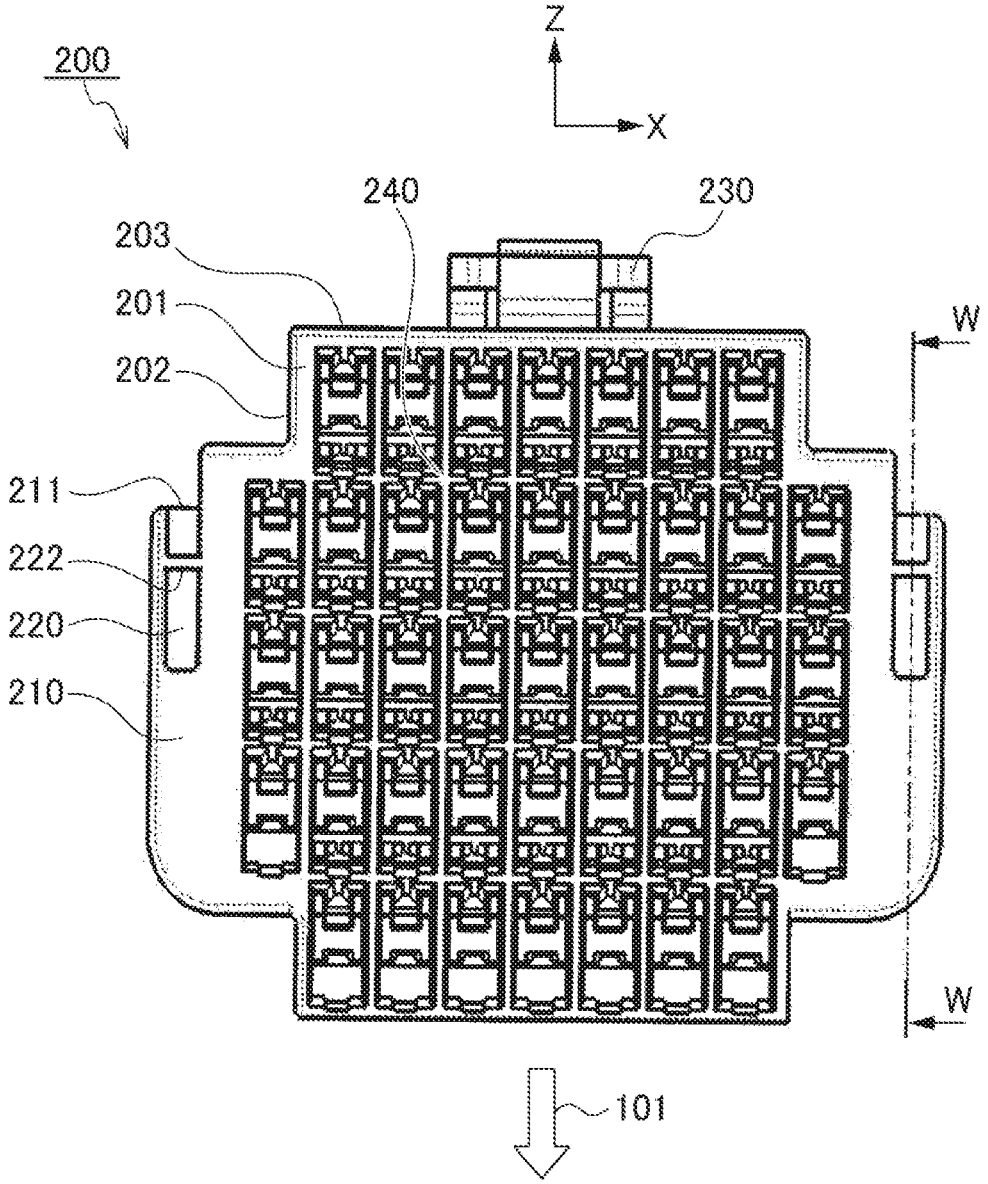
FIG. 5 is a rear view illustrating a part (female connector housing) of the component for describing the connector structure according to the first embodiment of the invention.
Figure 6:
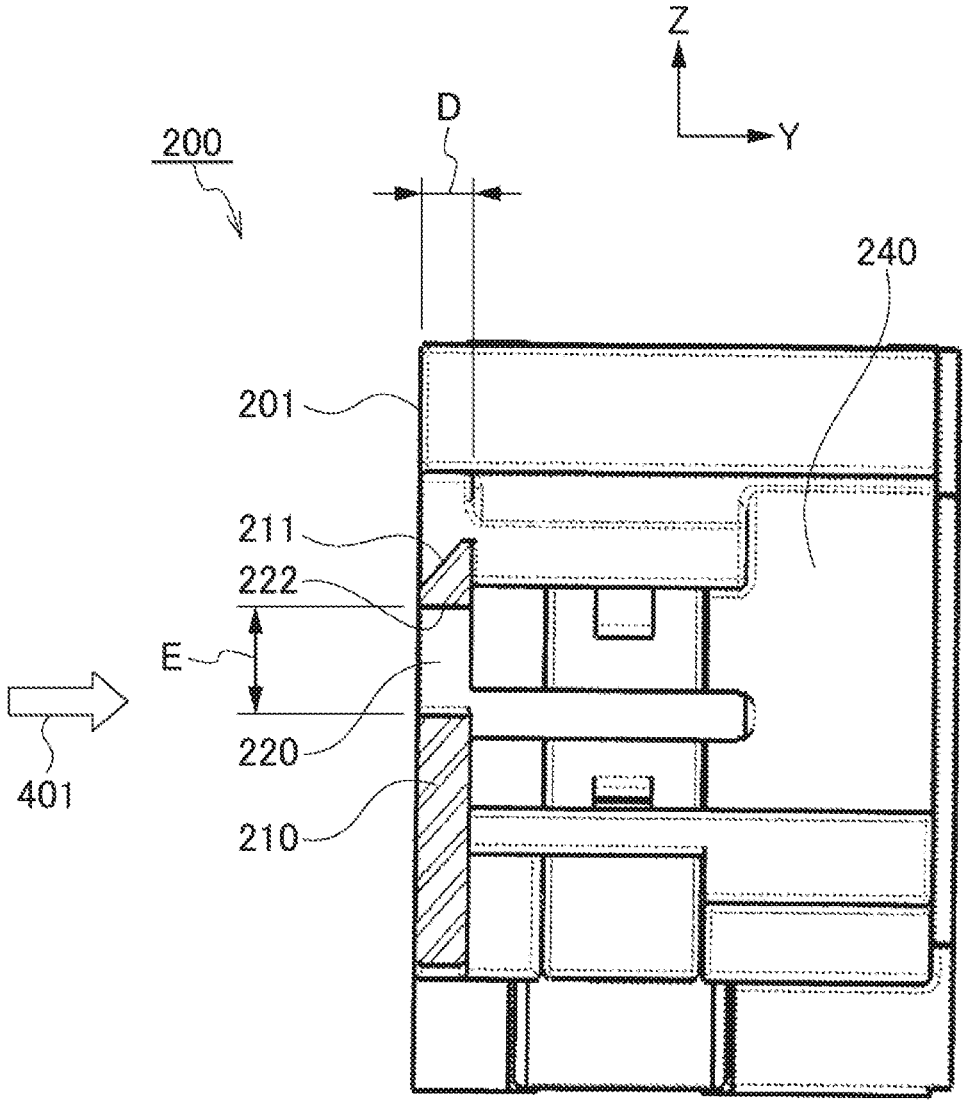
FIG. 6 is a cross-sectional view taken along a line W-W in FIG. 5 for describing the connector structure according to the first embodiment of the invention.

FIGS. 5 and 6 are drawings for describing the connector structure according to the first embodiment of the invention. FIG. 5 is a rear view illustrating a part (female connector housing) of the components. FIG. 6 is a cross-sectional view taken along a line W-W in FIG. 5. Incidentally, for the convenience of explanation, the X direction, the Y direction, and the Z direction are additionally depicted in FIG. 1.

In FIGS. 5 and 6, the female connector housing 200 is provided with a wire harness storage chamber 240 which accommodates the crimp terminal 420 (see FIG. 1) of the wire harness 400, and the wire harness storage chamber 240 is opened to the end surface (is the same as the end surface of a -Y direction; hereinafter, referred to as "female connector end surface") 201 on the opposite side to the wire harness inserting direction 401.

(Rib)

A rib 210 having a plate shape (including a rod shape) is formed in each of the outer surfaces (are the same as the outer surface in the X direction and the outer surface in the -X direction; hereinafter, referred to as "female connector side surface") 202 of the female connector housing 200 which face each other. The rib 210 is continuous to the female connector end surface 201 and protrudes in the side surface direction (the X direction and the -X direction, respectively). The rib 210 has a projecting strip shape along a direction (wire leading-out direction 101) in which the cover 100 is assembled to the female connector housing 200. When a thickness (a distance in the Y direction) of the rib 210 is set to "D" such that the rib 210 can be intruded to the cover arm space 113, the thickness D becomes slightly smaller than a cover arm gap A ($D<A$).

The end surface (is the same as the end surface on a side in the Z direction; hereinafter, referred to as "rib sliding surface") 211 of the rib 210 in the opposite direction to the wire leading-out direction 101 is inclined in the Y direction (to be separated from the female connector end surface 201) as it turns to the Z direction.

(Rib Groove)

A rib groove 220 which passes through the rib 210 in the Y direction is formed in the rib 210. When a length (is the same as the distance in the Z direction) of the rib groove 220 is set to "E" such that the cover projection 120 can be intruded to the rib groove 220, the length E becomes larger than the length C of the cover projection 120 ($E>C$). The surface on a side of the rib sliding surface 211 of the rib groove 220 is referred to as "rib groove surface 222".

Incidentally, the rib groove 220 passes through the rib 210, but the invention is not limited thereto. The rib groove may be a bottomed recess portion as long as the cover projection 120 can be intruded thereto.

(Engaging Lock)

An engaging lock 230 is provided on a surface (is the same as the surface in the Z direction; hereinafter, referred to as "female connector rear surface") 203 of the female connector housing 200 in the opposite direction to the wire leading-out direction 101. The engaging lock 230 protrudes to be movable forward and backward, and is engaged with an engaging lock groove 330 provided in the male connector housing 300 described below (see FIG. 9).

(Male Connector Housing)

Figure 7:
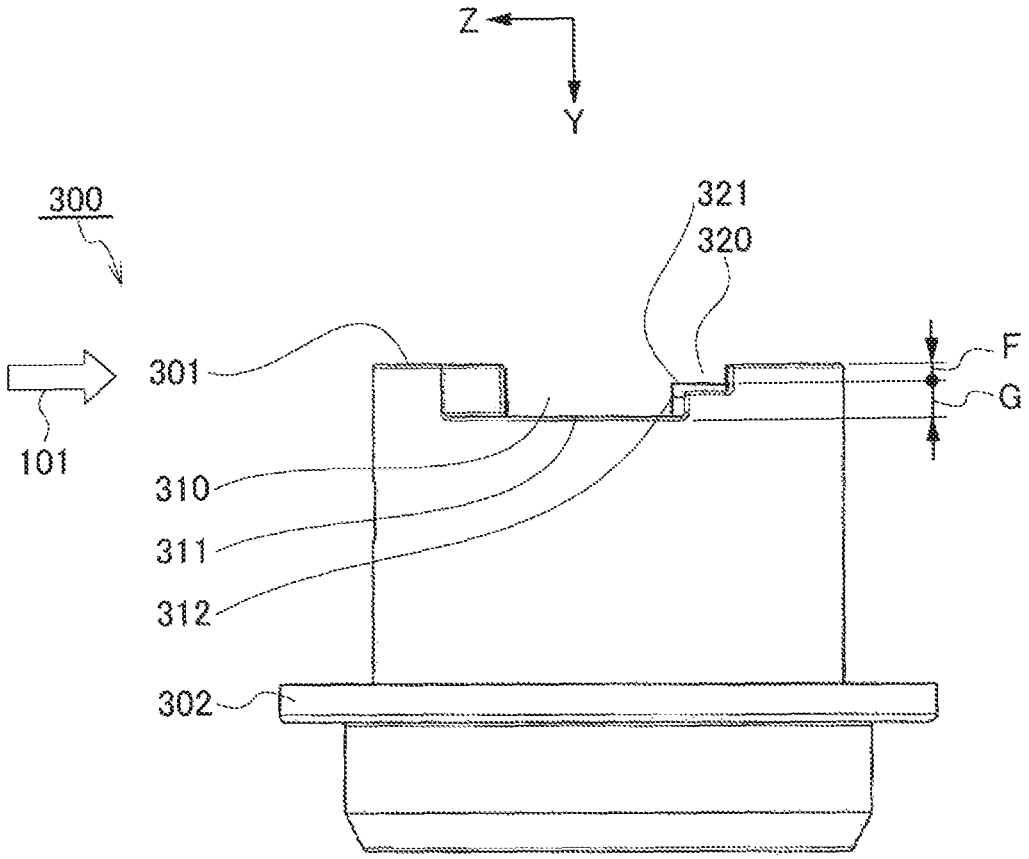
FIG. 7 is a side view illustrating a part (male connector housing) of the components for describing the connector structure according to the first embodiment of the invention.

FIG. 7 is a side view for describing the connector structure according to the first embodiment of the invention, illustrating a part (male connector housing) of the components. Incidentally, for the convenience of explanation, the X direction, the Y direction, and the Z direction are additionally depicted in FIG. 1.

In FIG. 7 and also in FIG. 1, the male connector housing 300 is provided with a male connector storage chamber 340 which accommodates the female connector housing 200.

The male connector storage chamber 340 is opened to the surface (is the same as the surface in the -Y direction; hereinafter, referred to as "male connector end surface") 301 on the opposite side of the wire harness inserting direction 401.

A rib accommodating notched portion 320 is formed in each of the positions (the position in the X direction and the position in the -X direction) of the male connector end surface 301 which face each other. A cover arm accommodating notched portion 310 is formed to be continuous to the rib accommodating notched portion 320. In other words, a space is formed which is not partitioned by the rib accommodating notched portion 320 and the cover arm accommodating notched portion 310.

(Rib Accommodating Notched Portion)

The rib 210 of the female connector housing 200 can be intruded to the rib accommodating notched portion 320 in a direction (Y direction) perpendicular to the male connector end surface 301, and a rib accommodating notched portion bottom 321 of the rib accommodating notched portion 320 is in parallel to the male connector end surface 301. When a distance (is the same as the distance in the Y direction; hereinafter, referred to as "rib accommodating notched portion depth") between the rib accommodating notched portion bottom 321 and the male connector end surface 301 is set to "F", the rib accommodating notched portion depth F is almost the same as the thickness D of the rib 210 ($F \approx D$).

(Cover Arm Accommodating Notched Portion)

In a state where the rib 210 is intruded to the rib accommodating notched portion 320, the cover arm 110 of the cover 100 is moved toward the wire leading-out direction 101 (-Z direction; this may be referred to as "intruding direction"), and can be intruded to the cover arm accommodating notched portion 310. The bottom (hereinafter, referred to as "cover arm accommodating notched portion bottom") 311 of the cover arm accommodating notched portion 310 is in parallel to the male connector end surface 301.

When a distance (is the same as the distance in the Y direction; hereinafter, referred to as "cover arm accommodating notched portion depth") between the cover arm accommodating notched portion bottom 311 and the rib accommodating notched portion bottom 321 is set to "G", the cover arm accommodating notched portion depth G is almost the same as the thickness B of the cover arm parallel portion 111 ($G \approx B$).

A stopper 312 is provided on a side (a side in the intruding direction) of the cover arm accommodating notched portion 310 in the wire leading-out direction 101 to stop the intrusion of the cover arm 110.

(Engaging Lock Groove)

The engaging lock groove 330 is formed at a position perpendicular to the rib accommodating notched portion 320 in the outer surface of the male connector housing 300 such that the engaging lock 230 of the female connector housing 200 is engageable therewith (see FIG. 1), and a male connector flange 302 is provided in an annular shape on the outer peripheral surface. The male connector flange 302 is a surface where the connector structure 1000 abuts on a device (not illustrated; for example, an automatic transmission case of a vehicle) when mounted in the device.

(Assembly)

Figure 8:
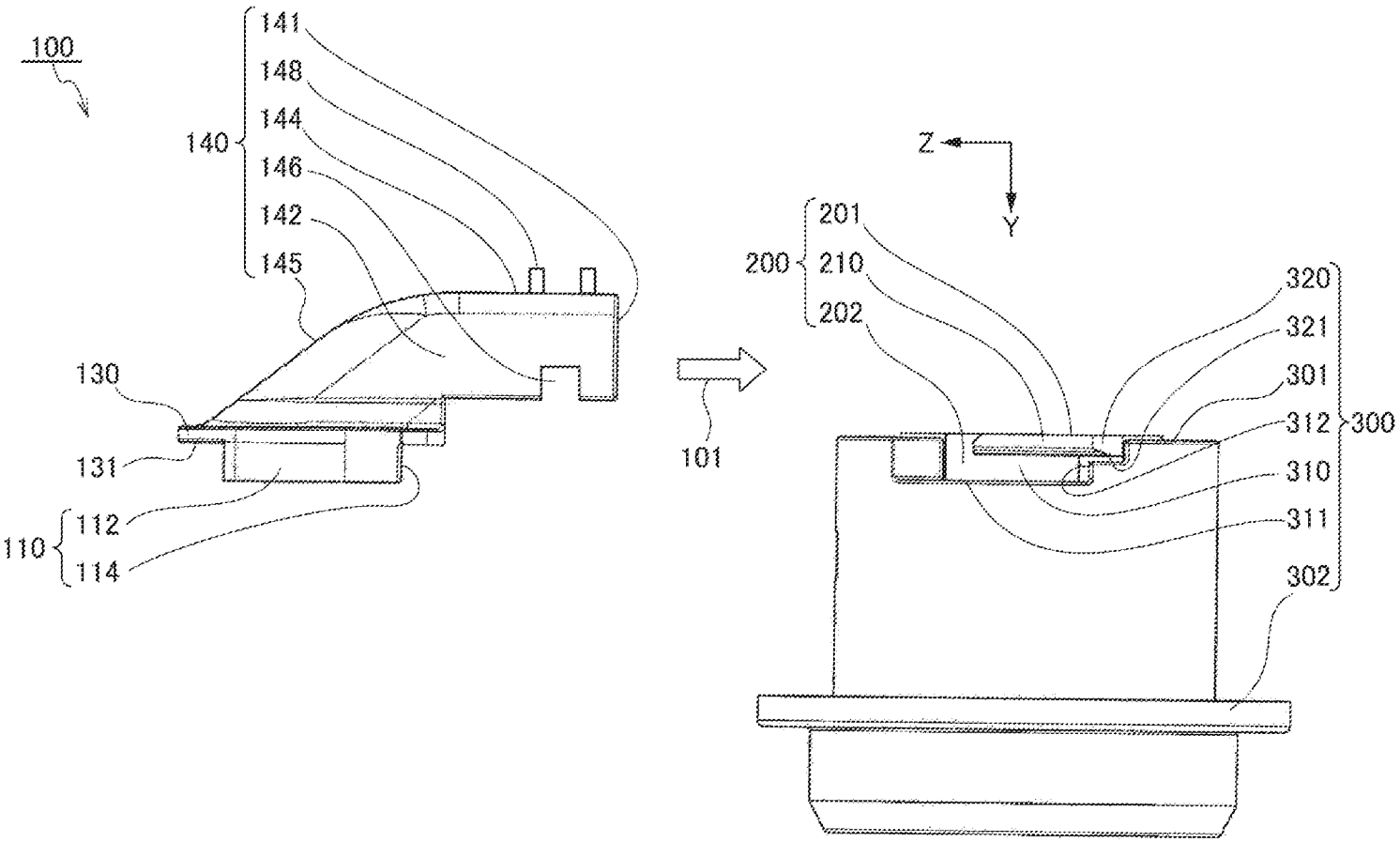
FIG. 8 is a side view illustrating an early stage of assembling for describing the connector structure according to the first embodiment of the invention.
Figure 9:
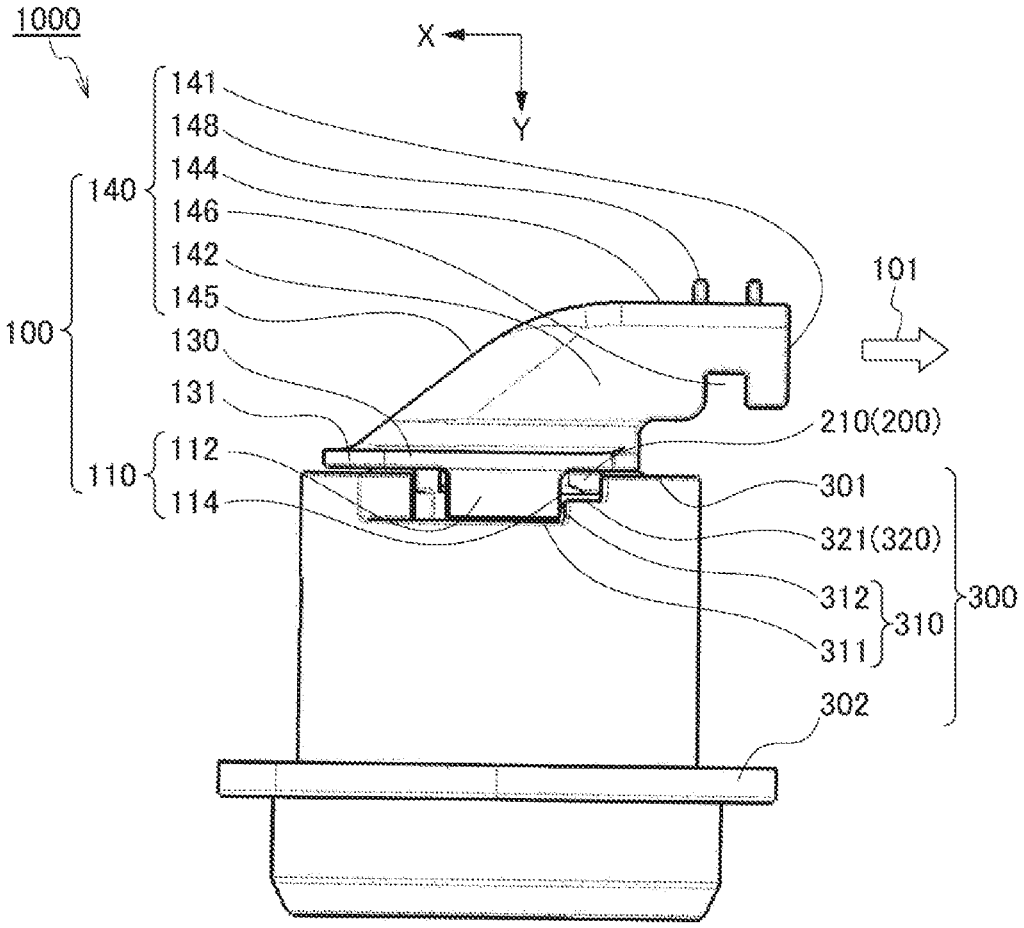
FIG. 9 is a side view illustrating an ending stage of assembling for describing the connector structure according to the first embodiment of the invention.
Figure 10:
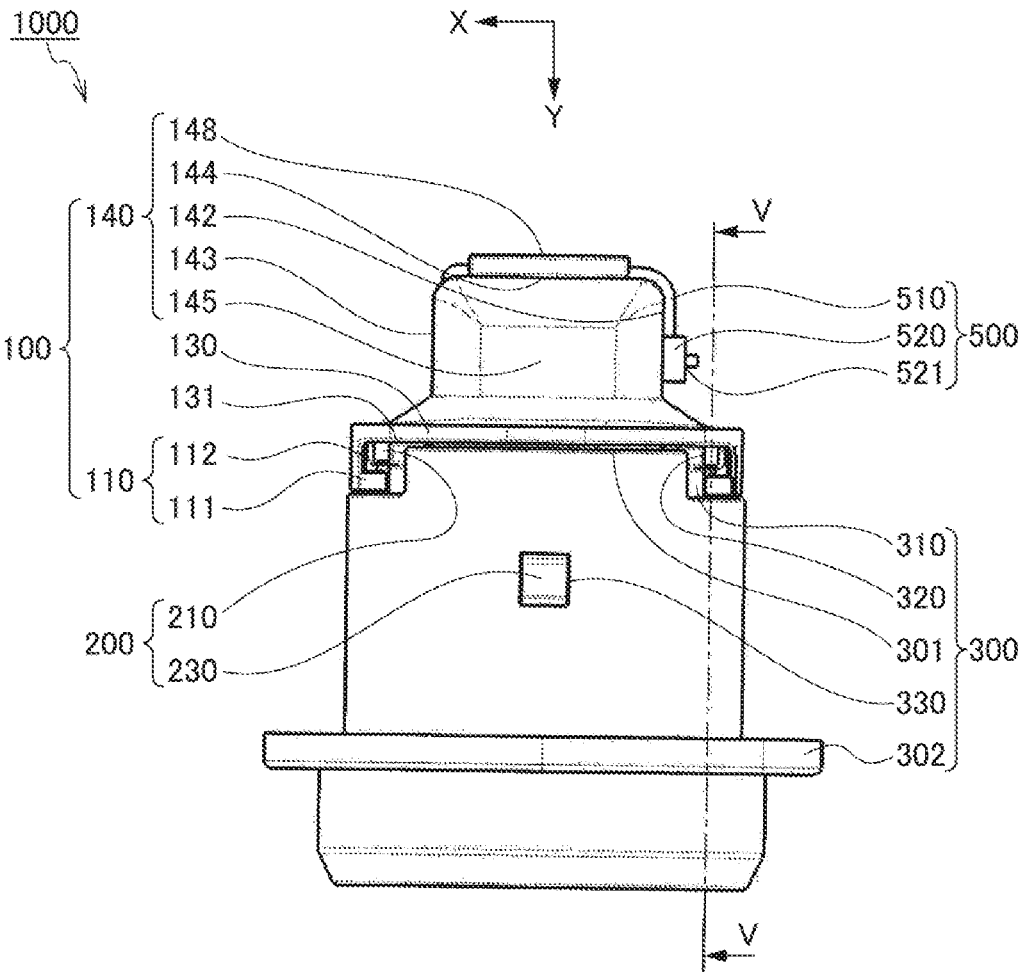
FIG. 10 is a rear view illustrating the ending stage of assembling for describing the connector structure according to the first embodiment of the invention.
Figure 11:
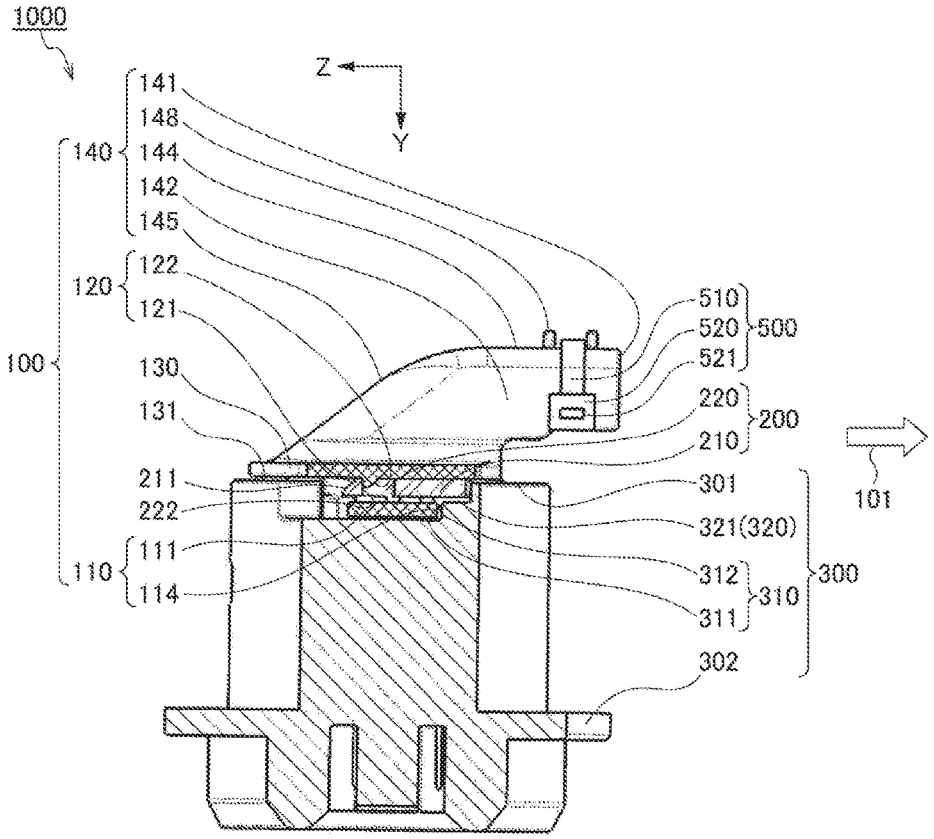
FIG. 11 is a cross-sectional view taken along a line V-V in FIG. 10 for describing the connector structure according to the first embodiment of the invention.

FIG. 8 is a side view for describing the connector structure according to the first embodiment of the invention, illustrating an early stage of assembly. FIG. 9 is a side view illustrating an ending stage of assembly. FIG. 10 is a rear view illustrating the ending stage of assembly. FIG. 11 is a cross-sectional view taken along a line V-V in FIG. 10. Incidentally, for the convenience of explanation, the X direction, the Y direction, and the Z direction are additionally depicted in FIG. 1. In FIGS. 9 to 11, a description of the wire 410 of the wire harness 400 (see FIG. 1) is omitted.

(Early Stage of Assembly)

In FIG. 8, the female connector housing 200 is accommodated in the male connector storage chamber 340 of the male connector housing 300 (see FIG. 1). At this time, the female connector end surface 201 and the male connector end surface 301 are positioned in almost the same surface, and the rib 210 is intruded to the rib accommodating notched portion 320. The engaging lock 230 of the female connector housing 200 is engaged with the engaging lock groove 330 of the male connector housing 300 (see FIG. 10). In other words, the female connector housing 200 is accommodated in the male connector housing 300 in an immovable manner (including an undetachable manner).

The cover flange end surface 131 of the cover 100 is disposed in almost the same virtual plane as the male connector end surface 301, and is moved in the wire leading-out direction 101 (intruding direction).

(Ending Stage of Assembly)

In FIGS. 9 to 11, the cover 100 is assembled to complete the connector structure 1000. In other words, the cover 100 is moved in the wire leading-out direction 101 (intruding direction) in a state where the rib 210 is accommodated in the rib accommodating notched portion 320, and the cover arm 110 is intruded to the cover arm accommodating notched portion 310. The rib 210 is intruded to the cover arm space 113 of the cover 100.

At this time, the cover flange end surface 131 of the cover 100 slides with the male connector end surface 301 and the female connector end surface 201, and the cover projection sliding surface 121 of the cover projection 120 is pressed against the rib sliding surface 211 of the female connector housing 200. When the rib 210 is bent (elastically deformed), the cover projection 120 goes over the rib sliding surface 211 and is intruded to the rib groove 220, then the rib 210 is elastically reaccommodated, and thus the cover projection intrusion surface 122 approximately abuts on the rib groove surface 222 or the rib groove 220.

The cover positioning surface 114 of the cover 100 about on the stopper 312 of the male connector housing 300.

Incidentally, the binding band 500 is attached to the cover hood 140, and the wire 410 (not illustrated) is securely fixed to the cover 100 (this will be separately described in detail).

(Operational Effects)

(a) As described above, in the connector structure 1000, the rib 210 is intruded to the rib accommodating notched portion 320, and the engaging lock 230 is engaged with the engaging lock groove 330, so that the female connector housing 200 is fixed to the male connector housing 300. In such a state, the cover arm 110 of the cover 100 is intruded to the cover arm accommodating notched portion 310 of the male connector housing 300, and the cover projection 120 of the cover 100 is intruded to the rib groove 220 of the female connector housing 200. Therefore, the cover 100 is not detachable due to the rib 210 of the female connector housing 200 and the rib groove 220, and positioned while suppressing rattling, and thus securely assembled.

(b) Since the cover arm 110 can be intruded to the cover arm accommodating notched portion 310 of the male connector housing 300 without causing elastic deformation of the cover arm 110 of the cover 100, the assembling is easy and the workability is good.

(c) The rib 210 of the female connector housing 200 is accommodated in the rib accommodating notched portion 320 of the male connector housing 300 and the cover arm 110 of the cover 100 is accommodated in the cover arm accommodating notched portion 310 of the male connector housing 300, and thus the cover 100 does not protrude to the outer surface of the male connector housing 300. In other words, the female connector housing 200 and the cover 100 are accommodated within the width of the male connector housing 300, and the connector structure 1000 can be minimized.

The wire 410 abuts on the cover hood slope 145 to bent in the wire leading-out direction 101 (not illustrated), but a bending force and a force to keep the bent posture become a force (a force in the -Y direction) to make the cover 100 draw away from the female connector housing 200, and are transferred to the rib 210 through the cover arm 110. Then, the cover arm 110 does not need to be bent (elastically deformed) as described above, so that the shape can have rigidity sufficient to endure the applied force without hindering workability of an assembling work.

In a case where a force to move the cover arm 110 in the opposite direction to the intruding direction (wire leading-out direction 101) is applied on the cover arm 110, the applied force is transferred to the female connector housing 200 through an abutting portion between the cover projection intrusion surface 122 of the cover arm 110 and the rib groove surface 222 of the female connector housing 200. At this time, the cover projection intrusion surface 122 and the rib groove surface 222 are perpendicular to a direction of the applied force, and thus the cover projection 120 is not separated from the rib groove 220. In other words, the cover 100 is securely assembled to the female connector housing 200.

(Binding Band)

Next, the binding band 500 will be described.

In FIGS. 10 and 11, the binding band 500 includes a flexible band portion 510, and a head portion 520 in which a binding hole 521 is formed such that the band portion 510 can pass through and cannot be detached from the binding hole. Irregularities (not illustrated) of a serrated shape in cross-sectional view are formed in the band portion 510, and projections (not illustrated) of a claw shape are formed in the binding hole 521 to constrain the irregularities only in one direction. Therefore, the band portion 510 can be intruded into the binding hole 521 from the tip end on the opposite side to the head portion 520, but is not detachable once being intruded.

The wire 410 (not illustrated; see FIG. 1) of the wire harness 400 is once led out of the female connector housing 200 in the -Y direction, then is bent to the wire leading-out direction 101 side (-Z direction) in the cover hood slope 145, and is guided by the cover hood left side surface 142, the cover hood right side surface 143, and the cover hood parallel surface 144, so as to be led out of the cover hood end surface 141 in the wire leading-out direction 101 (not illustrated).

The band portion 510 of the binding band 500 is guided to the cover hood notched portion 146 and the cover hood projecting strip 148, passes through the cover hood deficient portion 147 and, in this state, fixes the wire 410 to the cover 100. At this time, the head portion 520 of the binding band 500 is pressed against the vicinity of the cover hood notched portion 146 of the cover hood left side surface 142, and the band portion 510 is fastened up.

Then, the band portion 510 passes through the cover hood deficient portion 147 in a state where the binding band 500 is prevented from being deviated, directly abuts on the wire 410, and fixes the wire 410 to the cover 100. In other words, a fastening work of the binding band 500 becomes stable, the binding band 500 is fastened up sufficiently, and the wire 410 is fixed securely to the cover 100.

Since the band portion 510 can pass through the cover hood deficient portion 147 and is flexible, the wire 410 can be fixed to the cover 100 without being affected by the number of wires 410 to be led out. In other words, in a case where the number of wires 410 is less, the band portion 510 has almost a triangular shape in front view. In a case where the number of wires 410 is large, the band portion 510 has almost a trapezoidal shape in front view. Therefore, the band portion 510 can be fastened up.

Incidentally, the invention is not limited to the shape of the binding band 500 which is attached to the cover 100, and the wire 410 may be fixed to the cover 100 by a member different from the binding band 500.

Herein, the features of the embodiments of the connector structure according to the invention will be simply summarized as the following [1] to [3].

[1] A connector structure (1000) comprising a first connector housing (female connector housing 200);

a second connector housing (male connector housing 300) accommodating the first connector housing; and a cover (100) which restricts a leading-out direction of a wire (410) led out from the first connector housing, wherein the first connector housing, the second connector housing, and the cover are integrally assembled, wherein the cover includes a cover flange (130), a cover hood (140) formed on a side in the cover flange, a cover arm (110) protruding from a side opposite to the cover hood in the cover flange, and a cover projection (120) protruding from the side opposite to the cover hood in the cover flange and facing part of the cover arm, wherein the first connector housing includes a rib (210) formed on one of two facing outer surfaces along a direction in which the cover is assembled, a rib groove (220) formed by a notching part of the rib, and an engaging lock (230) formed on an outer surface, wherein the second connector housing includes an engaging lock groove (330) in which the engaging lock is engaged, a rib accommodating notched portion (320) accommodating the rib, and a cover arm accommodating notched portion (310) which is continuous to the rib accommodating notched portion and accommodates the cover arm, and wherein, in a state that the cover is assembled to the first connector housing accommodated in the second connector housing, the rib is accommodated in the rib accommodating notched portion, the engaging lock is engaged with the engaging lock groove, the cover arm is accommodated in the cover arm accommodating notched portion, the rib is positioned between the cover flange and the cover arm, and the cover projection is positioned in the rib groove.

[2] In the connector structure according to [1], the cover arm includes a cover arm parallel portion (111) which is in parallel to an end surface of the cover flange and a cover arm vertical portion (112) which is perpendicular to the end surface of the cover flange, and the cover projection is disposed at a position facing the cover arm parallel portion, and wherein the rib accommodated in the rib accommodating notched portion is positioned in a space (cover arm space 113) which is formed by three of part of the end surface of the cover flange, the cover arm parallel portion, and the cover arm vertical portion and has one open surface.

[3] In the connector structure according to [1] or [2], the cover arm accommodating notched portion includes a stopper (312) abutting on a surface on a side of the cover arm in an intruding direction.

The invention has been described in detail or with reference to specific embodiments, and it is deemed that a person skilled in the art could easily conceive that various modifications and changes may be made without departing from the spirit and the scope of the invention.

This application is based on Japanese Patent Application (No. 2015-241791) filed on Dec. 11, 2015, which is hereby incorporated by reference herein in its entirety.

As described above, in the connector structure according to the invention, the cover and the female connector housing are accommodated within the width of the male connector housing so as to be assembled easily and securely. Therefore, the connector structure may be widely used as a connector structure to be installed in various types of devices.

DESCRIPTION OF REFERENCE NUMERALS AND SIGNS

100: cover
101: wire harness leading-out direction
110: cover arm
112: cover arm vertical portion
113: cover arm space
114: cover positioning surface
120: cover projection
121: cover projection sliding surface
122: cover projection intrusion surface
130: cover flange
131: cover flange end surface
140: cover hood
141: cover hood end surface
142: cover hood left side surface
143: cover hood right side surface
144: cover hood parallel surface
145: cover hood slope
146: cover hood notched portion
147: cover hood deficient portion
148: cover hood projecting strip
200: female connector housing
201: female connector end surface
203: female connector rear surface
210: rib
211: rib sliding surface
220: rib groove
222: rib groove surface
230: engaging lock
240: wire harness storage chamber
300: male connector housing
301: male connector end surface
302: male connector flange
310: cover arm accommodating notched portion
311: cover arm accommodating notched portion bottom
312: stopper
320: rib accommodating notched portion
321: rib accommodating notched portion bottom
330: engaging lock groove
340: male connector storage chamber
400: wire harness
401: wire harness inserting direction
410: wire
420: crimp terminal
500: binding band
510: band portion
520: head portion
521: binding hole
1000: connector structure

What is claimed is:

1. A connector structure comprising
a first connector housing;
a second connector housing accommodating the first connector housing; and
a cover which restricts a leading-out direction of a wire led out from the first connector housing,
wherein the first connector housing, the second connector housing, and the cover are integrally assembled,
wherein the cover includes a cover flange, a cover hood formed on a side in the cover flange, a cover arm protruding from a side opposite to the cover hood in the cover flange, and a cover projection protruding from the side opposite to the cover hood in the cover flange and facing part of the cover arm,
wherein the first connector housing includes a rib formed on one of two facing outer surfaces along a direction in which the cover is assembled, a rib groove formed by a notching part of the rib, and an engaging lock formed on an outer surface,
wherein the second connector housing includes an engaging lock groove in which the engaging lock is engaged, a rib accommodating notched portion accommodating the rib, and a cover arm accommodating notched portion which is continuous to the rib accommodating notched portion and accommodates the cover arm, and
wherein, in a state that the cover is assembled to the first connector housing accommodated in the second connector housing, the rib is accommodated in the rib accommodating notched portion, the engaging lock is engaged with the engaging lock groove, the cover arm is accommodated in the cover arm accommodating notched portion, the rib is positioned between the cover flange and the cover arm, and the cover projection is positioned in the rib groove.

2. The connector structure according to claim 1,
wherein the cover arm includes a cover arm parallel portion which is in parallel to an end surface of the cover flange and a cover arm vertical portion which is perpendicular to the end surface of the cover flange, and the cover projection is disposed at a position facing the cover arm parallel portion, and
wherein the rib accommodated in the rib accommodating notched portion is positioned in a space which is formed by three of part of the end surface of the cover flange, the cover arm parallel portion, and the cover arm vertical portion and has one open surface.

3. The connector structure according to claim 1,
wherein the cover arm accommodating notched portion includes a stopper abutting on a surface on a side of the cover arm in an intruding direction.

4. The connector structure according to claim 2,
wherein the cover arm accommodating notched portion includes a stopper abutting on a surface on a side of the cover arm in an intruding direction.

* * * * *